United States Patent [19]

Teichert et al.

[11] 4,087,229

[45] May 2, 1978

[54] AUTOMATIC FUEL IGNITION SYSTEM WITH REDUNDANT FLAME SENSING

[75] Inventors: Allen L. Teichert, Placentia; William W. Chambers, Anaheim, both of Calif.

[73] Assignee: Robertshaw Controls Company, Richmond, Va.

[21] Appl. No.: 700,662

[22] Filed: Jun. 28, 1976

[51] Int. Cl.[2] ..... F23Q 9/08

[52] U.S. Cl. ..... 431/43; 431/25; 431/66

[58] Field of Search ..... 431/43, 25, 71, 66, 431/72, 50

[56] References Cited

U.S. PATENT DOCUMENTS

| | | | |
|---|---|---|---|
| 3,079,984 | 3/1963 | Wright et al. | 431/66 |
| 3,574,496 | 4/1971 | Hewitt | 431/25 X |
| 3,644,074 | 2/1972 | Cade | 431/25 X |
| 3,902,839 | 9/1975 | Matthews | 431/25 X |

*Primary Examiner*—Kenneth W. Sprague
*Assistant Examiner*—Larry Jones
*Attorney, Agent, or Firm*—Fulwider, Patton, Rieber, Lee & Utecht

[57] ABSTRACT

An automatic fuel ignition system has a spark generator for igniting a pilot burner and two separate pilot flame sensing systems to provide a redundant safety check of flame ignition before the main burner gas is turned on. One sensing system includes a rectifying electrode in the pilot burner flame and a electronic flame sensing circuit responsive to the flame conductivity while the second sensing system includes a flame switch located in the flame and responsive to the heat of the flame.

20 Claims, 1 Drawing Figure

AUTOMATIC FUEL IGNITION SYSTEM WITH REDUNDANT FLAME SENSING

BACKGROUND OF THE INVENTION

1. Field of the Invention

The present invention relates to control systems for heating apparatus and more particularly for automatic fuel igniting systems in which gaseous fuel is electrically ignited to start the flame used for heating.

2. Description of the Prior Art

The prior art includes examples of fuel igniting systems in which the flame is ignited by electronic flame igniting circuitry and then the flame is sensed by flame sensing circuitry. U.S. Pat. Nos. 3,902,838 and 3,938,937 describe pilot ignition systems in which flame sensing is accomplished using the principle of flame conductivity, and in which sensing of the flame causes de-activation of the spark generating circuitry. U.S. Pat. No. 3,806,305 discloses a spark ignition circuit using voltage multiplication in the spark generating circuitry. All of these prior art systems suffer a similar inadequacy in that no backup is provided for the flame sensing circuitry so that a failure of that circuitry could result in unlit raw gas flow.

SUMMARY OF THE INVENTION

The present invention is summarized in that an automatic fuel ignition system for a heating system having a main burner and a pilot burner includes the combination of a pilot valve supplying gas to the pilot burner, a main gas valve supplying gas to the main burner, condition responsive means for actuating the pilot valve, spark generator means for igniting the pilot burner, a sensing electrode in the pilot burner flame, an electronic flame sensing circuit responsive to the increased conductivity of the pilot flame for sensing the presence of the pilot flame, switching means responsive to the flame sensing circuit, and flame responsive switch means for sensing the heat of the pilot flame and connected to the switching means and the main gas valve so that the main gas valve can be actuated when the pilot flame is sensed by both of the flame sensing circuit and the flame responsive switch means.

An object of the present invention is to construct an automatic pilot electric ignition system in which the presence of the flame is sensed by two different sensing means sensing two different properties of the flame to ensure the presence of the flame before the main gas valve is opened.

Another object of the present invention is to provide such an automatic pilot ignition system in which there is a lockout means provided to shut down the system in the event the pilot fails to ignite in a predetermined time period.

It is yet another object of the present invention to construct such an automatic pilot ignition system including both the redundant flame sensing and the lockout means so that the lockout means will shut down the system unless both of the sensing means indicate the pilot is ignited within the predetermined time period.

Other objects, advantages, and features of the present invention will become apparent from the following description when taken in conjunction with the accompanying drawing.

DESCRIPTION OF THE PREFERRED EMBODIMENT

Figure 1:
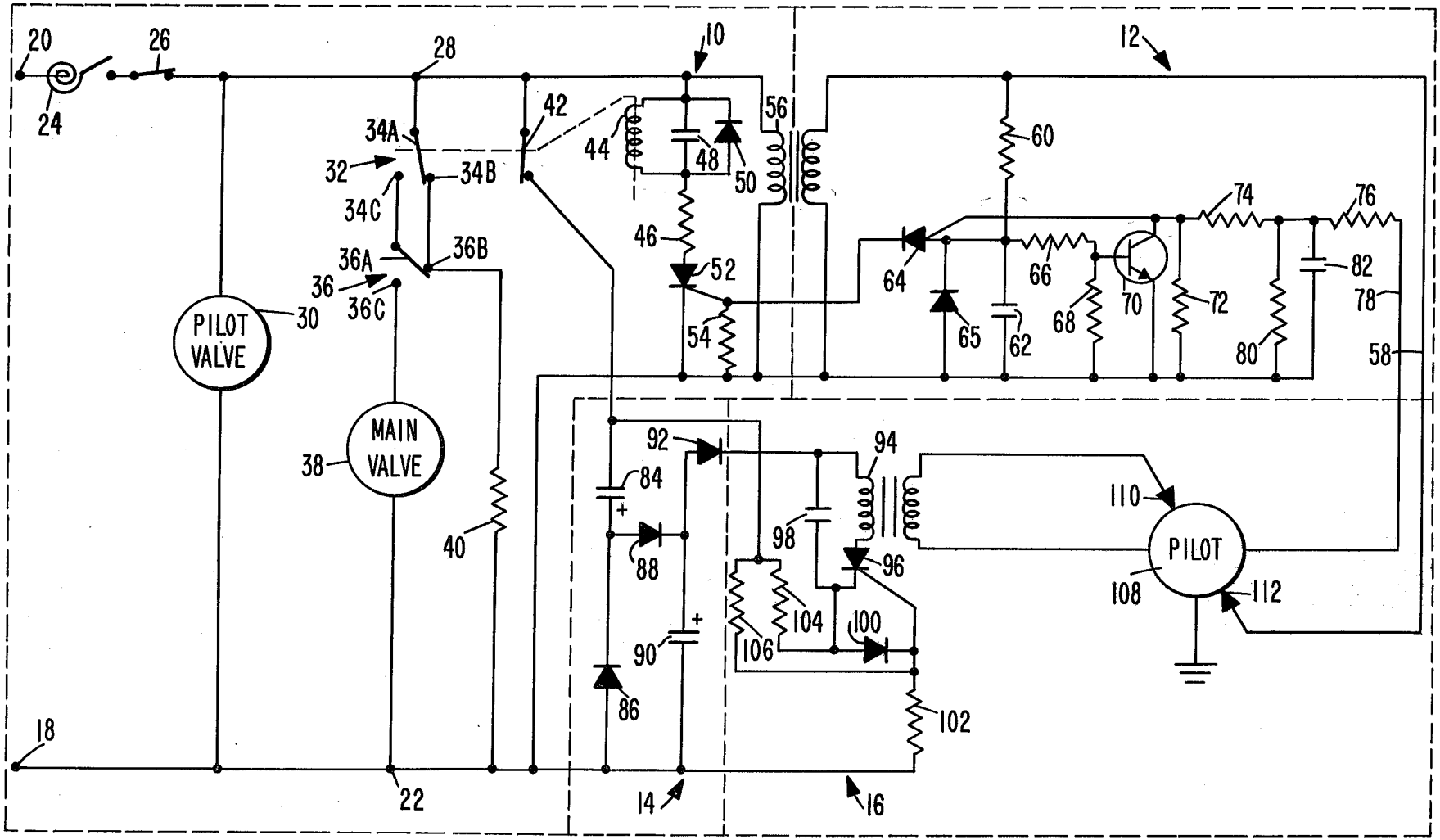
FIG. 1 is a schematic circuit diagram of an automatic pilot fuel ignition system constructed according to the present invention.

Shown in FIG. 1 is embodied in an automatic fuel ignition system with redundant flame sensing constructed according to the present invention. The system of FIG. 1 includes a main switching circuit generally indicated at 10, a flame sensing circuit, generally indicated at 12, a voltage multiplier, indicated at 14, and a spark generator, generally indicated at 16.

In the main switch circuit 10, a pair of terminals 18 and 20 are connected to a suitable source (not shown) of low voltage alternating current power, such as the 24 volt secondary of a conventional power step-down transformer connected to an AC power source. The terminal 18 connects to a circuit common node 22. The terminal 20 is connected to one side of a thermostatic switch 24, which is located inside the area to be heated by the heating system including therein the fuel ignition system of FIG. 1. The other side of the thermostatic switch 24 is connected to one side of normally closed lock-out switch contacts 26. The other side of the lock-out switch contacts 26 is joined to a voltage node 28. A pilot gas valve 30 is connected between the voltage node 28 and the common node 22. A main actuating relay, generally indicated at 32, has a first switch arm **34*a* wired to the voltage node 28 and switchable between a position contacting a normally closed contact 34B and a position contacting a normally open contact 34C. The contact 34C is joined to the switch arm 36A of a flame responsive switch, or flame switch generally indicated at 36. The flame switch 36 is a thermally responsive switch located so as to respond to the temperature increase created by a flame at the pilot burner. The contact 34B of the relay 32 is wired to a normally closed contact 36B of the flame switch 36. A main gas valve 38 is connected between a normally open contact 36C of the flame switch 36 and the common node 22. Wired between the contact 36B of the flame switch 36 and the common node 22 is a lock-out switch heater 40 which together with the lock-out switch contacts 26 composes a lock-out switch. The lock-out switch can be any of a variety of conventional electricallly or electro-thermally operated switches in which current flow through the lock-out switch heater 40 for a predetermined time period will cause opening of the lock-out contacts 26. A second set of normally closed contacts 42 are included in the main relay 32 with one side connected to the voltage node 28 and the other side connected to the voltage multiplier 14. A relay coil 44 of the main relay 32 has one side connected to the voltage node 28 and one side connected to a resistor 46. A capacitor 48 and a diode 50 are connected in parallel across the relay coil 44. A silicon controlled rectifier (SCR) 52 has its anode connected to the other side of the resistor 46, and its cathode connected to the common node 22. A resistor 54 connects the gate of the SCR 52 to the common node 22. A voltage step-up transformer 56 has its primary winding connected between the voltage node 28 and the common node 22. The transformer 56** is a medium voltage step-up transformer suitable for converting a conventional 24 volt AC signal to a 100 volt AC signal.

In the flame sensing circuit 12, the ends of the secondary winding of the transformer 56 are wired to the common node 22 and to a conductor 58 respectively. The ends of the secondary of the transformer 56 are wired so that the voltage produced at the conductor 58 is of the same polarity as the voltage at the voltage node 28 relative to the common node 22. A series circuit of a resistor 60 and a capacitor 62 is connected between the conductor 58 and the common node 22. A programmable unijunction transistor (PUT) 64 has its anode joined to the junction of the resistor 60 and the capacitor 62. The cathode of the PUT 64 is connected to the gate of the SCR 52. A diode 65 has its cathode wired to the anode of the PUT 64 and its anode wired to the common node 22. A pair of resistors 66 and 68 are connected between the anode of the PUT 64 and the common node 22. A transistor 70 has its base joined to the junction of the resistors 66 and 68. The emitter of the transistor 70 is joined directly to the common node 22 and its collector is wired to the gate of the PUT 64. A resistor 72 connects the collector of the transistor 70 with the common node 22. A pair of resistors 74 and 76 are connected in series circuit joining to the collector of the transistor 70 at one end and to a conductor 78 at the other. A parallel circuit of a resistor 80 and a capacitor 82 connects the junction of the resistors 74 and 76 with the common node 22.

In the voltage multiplier 14, the second set of relay contacts 42 are connected to one plate of a capacitor 84. The other plate of the capacitor 84 is wired to the cathode of a diode 86, the anode of which is joined to the common node 22. The cathode of the diode 86 is also connected to the anode of the diode 88. A capacitor 90 is wired between the cathode of the diode 88 and the common node 22. The cathode of the diode 88 is also connected to the anode of a diode 92, the cathode of which connects to the spark generator 16.

In the spark generator 16, the cathode of the diode 92 is connected to one side of the primary winding of a high voltage step-up transformer 94, the secondary of which generates a very high voltage. The other side of the primary of the transformer 94 is joined to the anode of a silicon controlled rectifier (SCR) 96. A capacitor 98 is wired so that one of its plates connects to the cathode of the SCR 96 and the other plate connects to the cathode of the diode 92. A diode 100 is connected with its anode joined to the cathode of the SCR 96 and its cathode joined to the gate of the SCR 96. The gate of the SCR 96 is also joined to the common node 22 through a resistor 102. A resistor 104 connects the cathode of the SCR 96 to the relay contacts 42. Similarly a resistor 106 connects the gate of the SCR 96 to the relay contacts 42.

One side of the secondary of the transformer 94 is connected to the body of a pilot burner 108, the body of the pilot burner 108 also being connected to ground. The conductor 78 from the flame sensing circuit 12 is also connected to the body of the pilot burner 108. The other side of the secondary of the transformer 94 is connected to a spark electrode 110 positioned adjacent the gas outlet of the pilot burner 108. A rectification sensing electrode 112 is positioned in the path of the flame produced by the pilot burner 108 and is connected to the conductor 58 of the flame sensing circuit 12.

In the general operation of the automatic fuel ignition and flame sensing system of FIG. 1, the main switching circuit 10 provides the switching to open and close the pilot valve 30 and the main valve 38 in response to the conditions indicated by the thermostatic switch 24, the flame switch 36 and the flame sensing circuit 12. The voltage multiplier 14 is actuated by the main switching circuit 10 to rectify and multiply the AC voltage supplied through the terminals 18 and 20 to supply a relatively high DC voltage to the spark generator 16. The spark generator 16 creates an electric spark between the spark electrode 110 and the body of the pilot burner 108 to ignite the gas exiting from the burner. The ignition of the gas in the pilot burner 108 is sensed by the flame sensing circuit 12 through the sensing electrode 112 using the relatively high conductivity of the flame itself. The flame sensing circuit 12 causes the main switching circuit 10 to operate the relay 32. Then once the heat of the flame is sensed by the flame switch 36, the main gas valve 38 is actuated to open the gas flow and light the main burner of the heating system.

In the detailed operation of the system of FIG. 1, AC voltage of preferably 24 volts is received through the terminals 18 and 20. The thermostatic switch 24 will close when there is a demand for heat in the area to be heated by the system. Inasmuch as the lock-out switch contacts 26 are normally closed, an AC voltage is then imposed between the voltage node 28 and the common node 22. This voltage causes the actuation of the pilot valve 30 thereby allowing gas flow to the pilot burner 108. At the same time current begins to flow through the switch arm 34A and the normally closed contact 34B of the first set of contacts of the relay 32 to heat the lock-out switch heater 40. At the same time AC current flows through the second set of contacts 42 of the relay 32 to the voltage multiplier 14.

In the voltage multiplier 14, the diode 86 and the capacitor 84 combine to create a DC voltage across the capacitor 84. The capacitor 84 will only charge when the diode 86 is forward biased, i.e. when the voltage at the common node 22 is more positive than the voltage at the voltage node 28 so that a DC voltage of approximately 24 volts is created across the capacitor 84 with the polarity indicated by the plus sign adjacent the capacitor 84. During the opposite half-cycle of the AC waveform, the voltage at the voltage node 28 is more positive than that at the common node 22 and current flows from the capacitor 84 through the diode 88 to the capacitor 90. Because at the peak of this half-cycle the voltage node 28 will be about 24 volts above the common 22, and since the capacitor 84 is charged to about 24 volts of the polarity indicated, the voltage produced across the capacitor 90 will be approximately 48 volts, with the polarity again indicated in FIG. 1. Thus the DC voltage at the anode of the diode 92 will be approximately 48 volts.

In the spark generator 16, as the voltage at the voltage node 28 drops, the charge on the capacitor 90 is transferred through the diode 92 to the capacitor 98 thus tripling to 72 volts. Then during the following half-cycle, the voltage at the common node 22 rises to exceed the voltage at the voltage node 28, and the voltage divider formed by the resistors 102 and 106 raises the voltage at the gate of the SCR 96. The SCR 96 triggers thereby discharging the capacitor 98 through the primary of the transformer 94. Recharging of the capacitor 98 during this half-cycle is prevented by the reverse-biased diode 100. The current pulse created by the discharge of the capacitor 98 through the SCR 96 is transmitted through the transformer 94 to its secondary. The secondary of the transformer 94 creates a high voltage potential between the spark electrode 110 and the body of the pilot burner 108 causing a spark to jump therebetween to light the gas escaping from the pilot burner 108. If the first spark does not ignite the gas, succeeding sparks will be generated during each cycle of the AC wave. Succeeding AC wave cycles will alternately charge the capacitor 98 on one half-cycle and then discharge the capacitor 108 through the transformer 94 to create a spark on the next half-cycle.

When the gas escaping from the pilot burner 108 is ignited, the presence of the flame will be sensed by the flame sensing circuit 12. A large AC voltage, such as 100 volts AC, is created by the step-up transformer 56 at its output between the conductor 58 and the common node 22. This voltage creates a large potential between the conductors 58 and 78. Current passes between the conductors 58 and 78 only when there is a flame at the pilot burner 108 due to the relatively high conductivity of a flame as opposed to open air. Due to the large electron emitting area of the pilot burner 108 relative to the sensing electrode 112, current will flow in significant quantity only from the conductor 58 through the sensing electrode 112 to the pilot burner 108 and therethrough to the conductor 78. This current will be passed through the resistor 76 to charge the capacitor 82 to create an increasing voltage at the gate of the PUT 64. The anode of the PUT 64 is also subjected to an increasing voltage during this same cycle of the AC wave as the capacitor 62 charges through the resistor 60. If no flame is present at the pilot burner 108, the anode of the PUT 64 quickly rises in voltage to exceed the voltage at the gate, and the PUT 64 triggers on. This discharges the capacitor 62 through the resistor 54. However, when there is no flame this occurs at the very start of the half-cycle of the AC wave, and since little charge will have been built up on the capacitor 62, the voltage across the resistor 54 will be insufficient to trigger into conduction the SCR 52. If the flame is present, however, the triggering of the PUT 64 will be delayed as the voltage at the gate of the PUT 64 rises as the capacitor 82 is charged through the conductors 58 and 78 at the same time as the capacitor 62 charges. After a time, the voltage at the anode will exceed that at the gate, however, and the PUT 64 will turn on discharging the capacitor 62 through the resistor 54. With the flame on and the capacitor 82 charged, sufficient charge would then have been built up on the capacitor 62 to create a voltage across the resistor 54 sufficient to trigger the SCR 52. The transistor 70 functions to ensure that the PUT 64 triggers on during each of the proper half-cycles. Its base is biased by the resistors 66 and 68 to increase in voltage as the capacitor 62 is charged. When the capacitor 62 is charged to a preselectable voltage, the transistor 70 turns on, rapidly lowering the voltage at the gate of the PUT 64 to trigger it into conduction, discharge the capacitor 62 and trigger the SCR 52.

Note that the flame sensing circuit 12 only senses the presence of the flame during half cycles of the AC waveform when the voltage node 28, and therethrough the conductor 58, is positive relative to the common node 22. This ensures electrical isolation between the sensing function and the ignition function of the system inasmuch as the spark generator 16 only creates a spark at the pilot burner 108 when the SCR 96 is triggered, and this only occurs when the common node 22 is positive relative to the voltage node 28. Thus during pilot ignition, spark generation and flame sensing occur on alternate half-cycles of the AC wave, ensuring no electrical interference between these two functions.

In the main switching circuit 12, the sensing of the ignition of the pilot flame by the flame sensing circuit 12 causes the SCR 52 to be triggered on. The conduction of the SCR 52 causes current to flow through the relay coil 44 of the relay 32. In addition the capacitor 48 is charged to maintain the relay coil 44 energized during the alternate half-cycles when the SCR 52 is not triggered by the flame sensing circuit 12. The energization of the relay coil 44 switches both the first switch arm 34 and the second set of contacts 42 of the relay. The second set of contacts 42 are opened thereby inhibiting the current flow to the voltage multiplier 14 to prevent any further spark creation by the spark generator 16. The switch arm 34A switches from the normally closed contact 34B to the normally open contacts 34C.

The main gas valve 38 is not energized merely by the actuation of the relay 32. Current still flows through the switch arm 36A of the flame switch 36 to the lock-out heater 40. The main gas valve 38 is operated when the flame switch 36 is heated by the pilot flame sufficiently to cause it to switch its switch arm 36A from the normally closed contact 36B to the normally open contact 36C. When the main gas valve 38 is operated, of course, gas flows to the main burner which is ignited by the pilot burner flame and the heating demand is satisfied. When the complete heating demand is met, the thermostatic switch 24 opens, deenergizing the pilot valve 30, the main gas valve 38, and the relay 32, thereby shutting down the whole system. Following a time delay the flame switch 36 will also reset to its normal position awaiting the next heating cycle.

Should either the relay 32 or the flame switch 36 fail to switch during the start-up cycle, the lock-out heater 40 would continue to be energized. This could occur because of any number of abnormal conditions either in the gas line or supply or because of failure of one or more of the components of the system of FIG. 1. In this event, after a preselectable time delay the lock-out heater 40 will cause the lock-out switch contact 26 to open, thereby removing all power from the system and shutting closed the pilot valve 30 to prevent further gas flow. Once the lock-out contacts 26 are opened, they must be manually reset before the system can be restarted. This ensures that any abnormal condition either in the gas supply or in the system of FIG. 1 will be brought to attention before the gas can be re-ignited.

In this way the presence of the pilot flame is redundantly sensed before the main burner can be lit. And this redundant sensing is accomplished in two diverse ways to further prevent any error. The flame sensing circuit 12 responds to the increased conductivity between the sensing electrode 112 and the body of the pilot burner 108 normally caused by the pilot flame. The flame switch 36 responds to the great increase in heat caused by that pilot flame. In this way the system of FIG. 1 has an increased safety margin over previously known systems and reduces drastically any chance that a sensing of the pilot flame could be erroneous.

The system of FIG. 1 also reduces drastically any chance that any component failure could lead to an open gas line condition. Without the flame switch 36, if the flame sensing circuit 12 fails in a flame-sensed condition, the spark generator 16 would be de-energized resulting possibly in unlit gas escaping. In the system of FIG. 1 including the flame switch, this is impossible. Similarly the failure of the flame switch 36 cannot alone lead to the escape of raw gas since the flame sensing circuit 12 would still function. Thus the failure of at least two components of the system is necessary before unlit gas can escape. This condition is made even more unlikely by the lock-out switch, including the lock-out heater 40 and the contacts 26, which ensure that most component failures will lead to system shut-down requiring manual reset. Thus the system of FIG. 1 greatly minimizes any chance of raw unlit gas flow to a degree previously unobtainable in automatic fuel igniting systems.

Inasmuch as the present invention is subject to many modifications, variations, and changes in detail, it is intended that all material in the a foregoing specification or accompanying drawing be interpreted as illustrative, rather than in a limiting sense.

What is claimed is:

1. In an automatic fuel ignition system for a heating system having a main burner system a pilot burner, the combination comprising a pilot valve for supplying gas to the pilot burner,
a main gas valve for supplying gas to the main burner,
condition responsive means for actuating the pilot valve,
spark generator means for igniting the pilot burner,
a sensing electrode in the pilot burner flame,
an electronic flame sensing circuit in circuit with said electrode and responsive to the increased conductivity of the pilot flame for sensing the presence of the pilot flame,
switching means responsive to the flame sensing circuit to actuate the main gas valve in response thereto, and
flame responsive switch means for sensing the heat of the pilot flame and connected in circuit with the switching means and the main gas valve so that the main gas valve can be actuated only when the pilot flame is sensed by both the flame sensing circuit and the flame responsive switch means.

2. An automatic fuel ignition system as claimed in claim 1 wherein a lock-out switch is connected in circuit to the switching means and to the flame sensing switch means whereby the lock-out switch acts to deactuate the pilot valve when either of the switching means and the flame responsive switch means fails to sense the pilot flame in a predetermined time period.

3. An automatic fuel ignition system as claimed in claim 2 wherein the switching means is a relay having a first switch arm switchable between a normally closed and a normally open contact, the normally closed contact being connected to the lock-out switch.

4. An automatic fuel ignition system as claimed in claim 2 wherein the lock-out switch includes a lock-out heater and a set of lock-out switch contacts.

5. An automatic fuel ignition system as claimed in claim 4 wherein the lock-out switch contacts are connected in series with the condition responsive switch means so as to de-energize the system when opened.

6. An automatic fuel ignition system as claimed in claim 3 wherein the flame responsive switch means is a flame switch having a switch arm switchable between normally open and normally closed contacts, the normally closed contact being connected to the lock-out switch.

7. An automatic fuel ignition system as claimed in claim 3 wherein the relay further includes a second set of contacts connected to supply contact to the spark generator when the switch arm of the relay is switched to the normally closed contact.

8. An automatic fuel ignition system as claimed in claim 6 wherein the normally open contact of the relay is connected to the switch arm of the flame switch and the normally open contact of the flame switch is connected to the main gas valve, so that the main gas valve is actuated when the switch arms of both the relay and the flame switch are switched to the respective normally open contacts.

9. An automatic fuel ignition system as claimed in claim 8 wherein the lock-out switch includes a lock-out switch heater and a set of lock-out switch contacts, the normally closed contacts of both of the relay and the flame switch being connected to the lock-out switch heater.

10. An automatic fuel ignition system for a heating system having a main burner and a pilot burner comprising condition responsive switch means for energizing the system,
a pilot valve actuated by the condition responsive switch means to supply gas to the pilot burner,
spark generating means for igniting the pilot burner,
flame sensing means which comprises an electronic flame sensing circuit for sensing the presence of the pilot burner flame and switching means responsive thereto for switching from a first to a second state,
a flame switch responsive to the heat of said pilot burner flame,
a main gas valve in circuit with said switching means and said flame switch and actuated by the switching of the switching means and flame switch to supply gas to the main burner, and
lock-out switch means including actuator means and contact means, the actuator means being in the first state for a predetermined time to operate the contact means for deenergizing the system and being moved from said first state responsive to both of said switching means and said flame switch.

11. An automatic fuel ignition system as claimed in claim 10 wherein the flame sensing and switching means include an electronic flame sensing circuit responsive to the conductivity of the flame and a relay actuated by the flame sensing circuit.

12. An automatic fuel ignition system as claimed in claim 11 wherein the relay includes a first switch arm and the first arm of the relay and the flame switch are both connected in series with the main gas valve so that the flame must be redundantly sensed before the main gas valve is actuated.

13. An automatic fuel ignition system as claimed in claim 12 wherein the actuator means is connected to be responsive to both the first switch arm of the relay and the flame switch so that the actuator means is responsive to one of the first switch arm of the relay and the flame switch not sensing the flame.

14. An automatic fuel ignition system as claimed in claim 13 wherein the actuator means is a heater.

15. An automatic fuel ignition system for a heating system having a main burner and a pilot burner comprising a pilot valve supplying gas to the pilot burner
a main gas valve supplying gas to the main burner
condition responsive means for actuating the pilot valve,
automatic ignition means to ignite the pilot burner, conductivity responsive flame sensing means for sensing the pilot burner flame by responding to the flame conductivity, and thermally responsive flame sensing means for sensing the pilot burner flame by responding to the flame heat, the main gas valve being actuated only when both of the conductivity responsive flame sensing means and the thermally responsive flame sensing means sense the pilot burner flame.

16. An automatic fuel ignition system as claimed in claim 15 wherein the conductivity responsive flame sensing means includes a sensing electrode in the pilot burner flame and an electronic flame sensing circuit responsive to current flow through the sensing electrode.

17. An automatic fuel ignition system as claimed in claim 15 wherein the thermally responsive flame sensing means is a flame switch switchable between a first and second contact in response to the heat of the pilot burner flame.

18. An automatic fuel ignition system as claimed in claim 15 further including lock-out means to de-actuate the pilot valve when either of the conductivity responsive flame sensing means and the thermally responsive flame sensing means fails to sense the pilot burner flame in a predetermined time period

19. An automatic fuel ignition system as claimed in claim 15 wherein the automatic ignition means includes a spark generator for generating a spark to ignite the pilot burner flame.

20. An automatic fuel ignition system as claimed in claim 19 wherein the spark generator is de-energized when the pilot burner flame is sensed by the conductivity responsive flame sensing means.

* * * * *

UNITED STATES PATENT OFFICE

CERTIFICATE OF CORRECTION

Patent No. 4,087,229 Dated May 2, 1978

Inventor(s) Allen L. Teichert et al

It is certified that error appears in the above-identified patent and that said Letters Patent are hereby corrected as shown below:

Claim 7, line 3, change "contact" to --current--.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*